US008127652B1

(12) United States Patent
Hennings et al.

(10) Patent No.: US 8,127,652 B1
(45) Date of Patent: Mar. 6, 2012

(54) APPARATUS AND METHOD OF MAKING A DOUBLE FINGER TRAP LOOP

(75) Inventors: Elsa J. Hennings, Ridgecrest, CA (US); Julia N. Martin, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 19 days.

(21) Appl. No.: 12/871,581

(22) Filed: Aug. 30, 2010

(51) Int. Cl.
*D04C 1/06* (2006.01)

(52) U.S. Cl. ..... 87/13

(58) Field of Classification Search ..... 57/21, 22, 57/201, 202; 474/253; 87/13
See application file for complete search history.

(56) References Cited

U.S. PATENT DOCUMENTS

| | | | | | |
|---|---|---|---|---|---|
| 330,087 | A | * | 11/1885 | Binns | 474/253 |
| 592,686 | A | * | 10/1897 | Binns | 474/253 |
| 758,286 | A | * | 4/1904 | Warner | 87/9 |
| 1,224,203 | A | * | 5/1917 | Patten | 474/253 |
| 1,655,752 | A | * | 1/1928 | Coe | 474/253 |
| 1,967,102 | A | * | 7/1934 | Schlegel | 87/9 |
| 2,943,434 | A | * | 7/1960 | Joy et al. | 57/202 |
| 3,026,762 | A | * | 3/1962 | Jordan | 87/8 |
| 4,099,750 | A | * | 7/1978 | McGrew | 289/1.5 |
| RE33,389 | E | * | 10/1990 | Beck | 474/253 |
| 5,583,319 | A | * | 12/1996 | Lieurance | 174/84 R |
| 5,699,657 | A | * | 12/1997 | Paulson | 57/22 |
| 7,240,475 | B2 | * | 7/2007 | Smeets et al. | 57/201 |

* cited by examiner

*Primary Examiner* — Shuan R Hurley
(74) *Attorney, Agent, or Firm* — James M. Saunders

(57) ABSTRACT

A double finger trap loop includes at least one braid having a first end and a second end. The braid is defined by an inner portion and an outer portion. The inner portion is a hollow conduit in the braid. The braid is readily adaptable to accept the first end and the second end into the hollow conduit. The first end and the second end are associated with each other. The association is capable of adhering the first end to the second end by a continuous internal stitch.

5 Claims, 2 Drawing Sheets

APPARATUS AND METHOD OF MAKING A DOUBLE FINGER TRAP LOOP

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to finger trap loops, and more particularly, double finger trap loops in parachutes and other weight-critical aircraft applications.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

The invention generally relates to finger trap loops, and more particularly, double finger trap loops in parachutes and other weight-critical aircraft applications.

Cords are used in a variety of applications in both civilian and military matters. Many high strength, low elongation textile cords used in parachute design and other weight-critical applications lose more than half their strength when knotted due to their molecular composition. These cords must be connected through a technique called finger trapping.

The finger trap technique is used to connect high strength, low elongation braided cords to other cords or to itself to form a loop. To make a fingertrap, one end of the cord is inserted into the center of another cord (or itself to make a loop), and the end of the other cord is inserted into the center of the first cord. When a load is applied to the cord(s), the braid of the outer cord geometrically elongates, which causes it to collapse radially, applying sufficient friction to trap the inner cord. Typically, the ends of the cord are tapered inside to minimize stress risers where a single layer meets a double layer of cord. The stress risers occur at radius changes and reduce overall tensile strength. This point on the outer cord is where structural failure occurs, which is typically 80 to 90 percent of the cord strength. Additionally, the inner cord adds to the weight of the assembly but does not add to the strength resulting in a heavier than necessary joint. Because of this, it is desirous to find an improved strength double finger trap loop.

Figure 1:
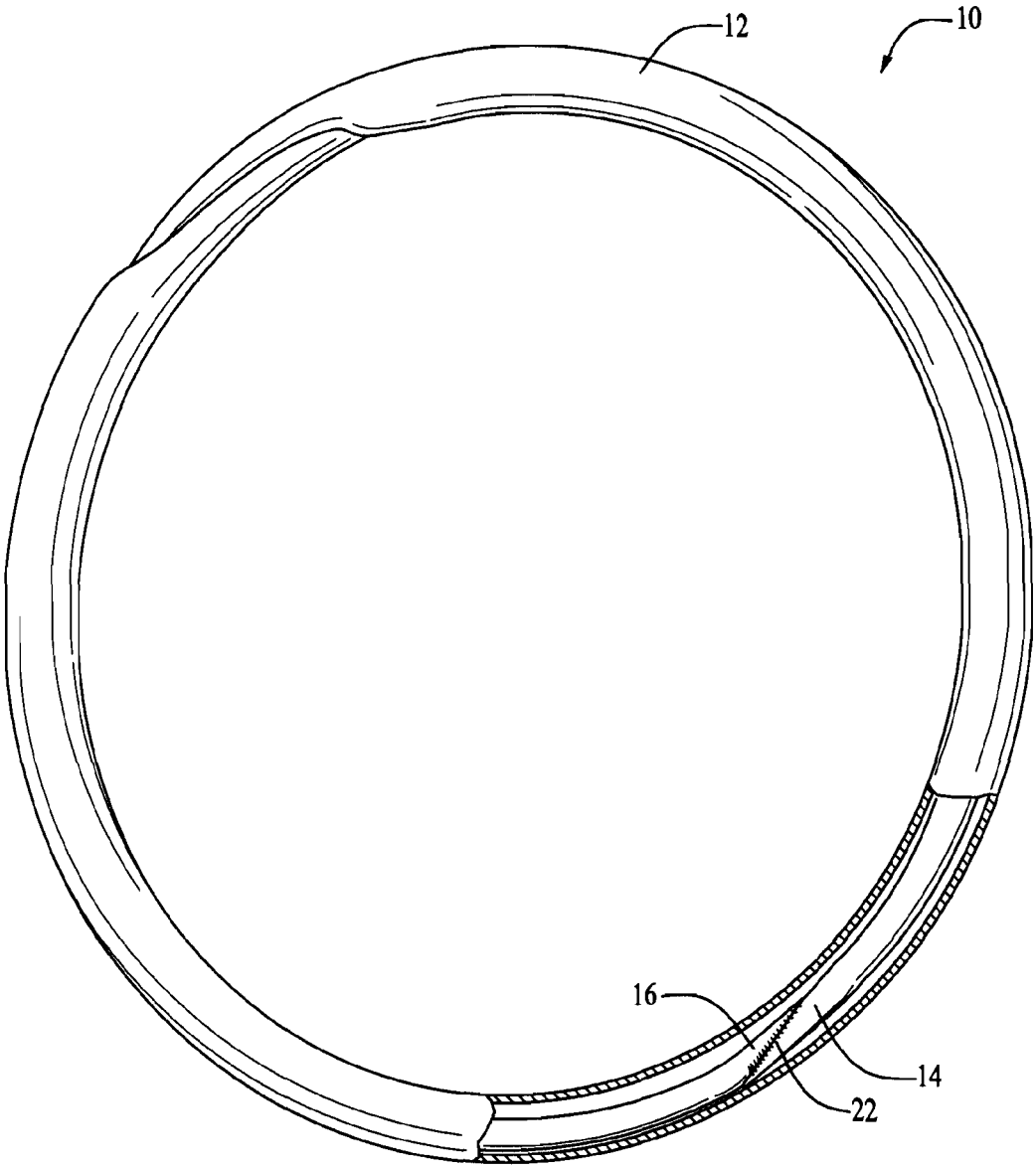
FIG. 1 illustrates a perspective and partial sectional view of a double finger trap loop with an outer portion of a cord removed to expose an overlap of cord ends inside the cord.

Referring to the accompanying drawings in which like reference numbers indicate like elements, FIG. 1 illustrates a first aspect of a double finger trap loop. Reference character 10 generally indicates an apparatus of embodiments of the invention.

As depicted in FIG. 1, the apparatus 10 is a loop of rope having at least one braid 12. Any number of braids 12 may be used depending on operational circumstances. The braid 12 is a high strength, low elongation cord and has a first end 14 and a second end 16.

Figure 2:
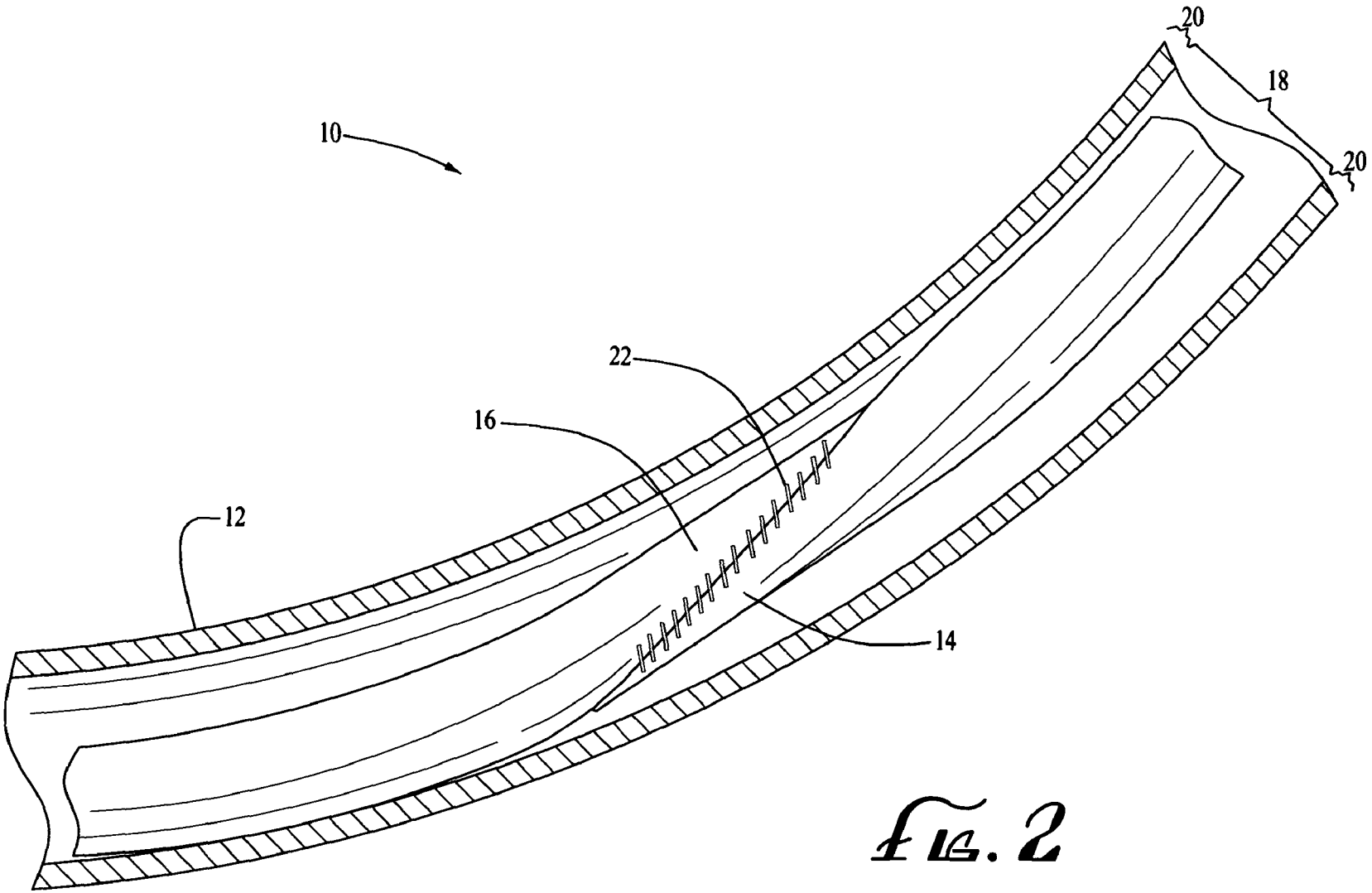
FIG. 2 illustrates a sectional view of a double finger trap loop with an outer portion of cord removed to expose cord ends stitched together.

In an embodiment shown in FIG. 2, the apparatus is depicted in a sectional view. The braid 12 has an inner portion 18 and an outer portion 20. The outer portion 20 in FIG. 2 is partially removed. The inner portion 18 is a hollow conduit within the braid 12. The hollow conduit 18 is centrally located within the braid 12. The hollow conduit 18 is a function of braided cords and allows the braid 12 to be readily adaptable to accept both the first end 14 and second end 16 into the hollow conduit.

The first end 14 and second end 16 are associated with each other. The association is capable of adhering the first end 14 to the second end 16, but the adherence is not required. Adherence may be an internal stitch 22 (also shown in FIG. 1). The internal stitch 22 is a continuous stitch and adheres the first end 14 to the second end 16, thus completing the loop of rope 10. Stitch overlap spacing can be adjusted and varies depending on operational circumstances. Additionally, any number of individual stitches can be used in lieu of a continuous stitch. It should also be noted that mating hooks, glue, or other suitable association devices may be used instead of stitches. Furthermore, the first 14 and second 16 ends are tapered such that, when stacked one on top of the other, the diameter of the stack is the same as the diameter of the rope.

Another embodiment of the invention includes a method of making a loop of rope 10. One skilled in the art will recognize that the method of making the loop of rope can be performed by an individual or automated such as, for example, with a machine. At least one braid 12 is provided. The braid 12 has a first end 14 and a second end 16 and is defined by an inner portion 18 and an outer portion 20. The inner portion 18 is a hollow conduit in the braid 12, which allows the braid to readily accept the first end 14 and the second end 16 into the hollow conduit.

The first end 14 and second end 16 may be associated by an internal stitch 22. The internal stitch 22 may be a continuous stitch or other suitable associating device that is readily adaptable for securing the first end 14 to the second end 16. A user tapers the first end 14 and second end 16 at suitable angles to facilitate connecting the first end to the second end. The taper angles are dependent on operational requirements.

Tapering the first 14 and second ends 16 of the braid 12 allows them to be stacked on top of each other so that they can be attached together, or laid one on top of the other, while retaining a uniform inner cord radius. Changes in the radius would result in a stress riser that would ultimately break first when enough load is applied.

The braid 12 is separated in at least two places to expose the hollow conduit 18 in at least two locations. One skilled in the art will recognize that ropes are a conglomeration of braided yarns. The two separated places are gaps created by spreading braided yarns on the braid 12 and may be located anywhere along the braid that meets operational needs. Both the first 14 and second 16 ends are inserted into the hollow conduit 18 using a Bodkin tool in the at least two places. One skilled in the art will recognize that a Bodkin tool is used to create finger trap loops. The first end 14 and second end 16 are pulled through the hollow conduit 18 and out another of one of the at least two locations with the Bodkin tool.

The user may connect the first end 14 to the second end 16 by actuating and securing the associated first end and second end by sewing the internal stitch 22 into the tapered ends to secure the ends together. This allows the first 14 and second 16 ends to stay in place as load is applied. Stitch 22 spacing is dependent on operational circumstances. The loop 10 is completed by feeding the first 14 and second 16 ends back into the hollow conduit 18 in such manner that both the first and second ends reside inside the hollow conduit. After the first 14 and second 16 ends are tucked back inside the hollow conduit 18, the gaps are closed.

This process eliminates the stress riser inherent in standard finger traps, dramatically increasing the original strength of the cord and thus reducing the overall weight since a lighter weight material can be used to generate the required strength. These aspects are crucial when lightweight materials are needed, seconds count, and lives are at stake. As such, the apparatus 10 may be used in applications such as, for example, flight, space, aircraft, and attachment tethering systems.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A loop of rope, comprising:

at least one braid having a first end and a second end, said braid being defined by an inner portion and an outer portion, said inner portion being a hollow conduit in said braid, said braid being readily adaptable to accept said first end and said second end into said hollow conduit; and wherein said first end and said second end are associated with each other, said association being capable of adhering said first end to said second end, wherein said association is a continuous internal stitch.

2. The rope according to claim 1, wherein said at least one braid is a high strength, low elongation cord.

3. The rope according to claim 1, wherein said first and second ends of said braid are adaptable to tapering.

4. A method of making a loop of rope, comprising:

providing at least one braid, said at least one braid having a first end and a second end, said braid being defined by an inner portion and an outer portion, said inner portion having a hollow conduit, said braid being readily adaptable to accept said first end and said second end into said hollow conduit;

separating said at least one braid in at least two locations to expose said hollow conduit in said at least two locations;

inserting said first end and said second end into said hollow conduit in one of said at least two locations;

pulling said first end and said second end through said hollow conduit and out another of one of said at least two locations;

tapering said first end and said second end;

associating said first end to said second end;

actuating and securing said associated said first end to said second end by stitching said first end to said second end; and feeding said first and second ends back into said hollow conduit to form a loop.

5. The method of claim 4, wherein said pulling step further comprises using a bodkin tool to pull said first end and said second end through said hollow conduit.

* * * * *